US005775651A

United States Patent [19]

Jackovich

[11] Patent Number: 5,775,651

[45] Date of Patent: Jul. 7, 1998

[54] DEVICE FOR HOLDING A CONTAINER INVERTED FOR EMPTYING

[76] Inventor: Steven J. Jackovich, 919 25th St., Bettendorf, Iowa 52722

[21] Appl. No.: 724,102

[22] Filed: Sep. 30, 1996

[51] Int. Cl.[6] ..... A47G 23/02

[52] U.S. Cl. ..... 248/213.2; 24/489; 248/316.5; 248/211; 248/229.16; 248/229.26

[58] Field of Search ..... 248/213.2, 211.3, 248/316.5, 229.16, 229.26; 24/3.11, 3.12, 334, 338, 132 R, 132 AA, 115 G, 457–489, 501

[56] References Cited

U.S. PATENT DOCUMENTS

| | | | |
|---|---|---|---|
| 589,088 | 8/1897 | Isbell | 248/211 |
| 754,285 | 3/1904 | Dick | 248/316.5 X |
| 965,707 | 7/1910 | Hammond | 248/316.5 X |
| 1,029,414 | 6/1912 | Bennett . | |
| 1,891,099 | 12/1932 | Land | 248/229.26 |
| 2,200,024 | 5/1940 | DeSipio . | |
| 2,307,554 | 8/1943 | Charipar . | |
| 2,794,537 | 6/1957 | Holliday | 24/489 X |
| 2,803,417 | 8/1957 | Gruber | 248/229.16 X |
| 2,896,894 | 7/1959 | Welsh | 248/211 |
| 3,295,812 | 1/1967 | Scheider et al. | 248/229.16 |
| 3,337,880 | 8/1967 | Florek . | |
| 3,589,338 | 6/1971 | Lovitz . | |
| 3,979,097 | 9/1976 | Baine | 248/211 |
| 3,986,694 | 10/1976 | Nowak | 248/211 |
| 4,032,100 | 6/1977 | Kahn | 248/211 |
| 4,895,329 | 1/1990 | Sloan | 248/229.16 |
| 4,957,260 | 9/1990 | Shelley . | |
| 5,318,292 | 6/1994 | De Marco | 24/489 X |

FOREIGN PATENT DOCUMENTS

| | | | |
|---|---|---|---|
| 561390 | 10/1923 | France | 248/229.16 |

*Primary Examiner*—Randolph A. Reese
*Assistant Examiner*—Robert J. Sandy
*Attorney, Agent, or Firm*—Henderson & Sturm

[57] ABSTRACT

A device for holding containers, particularly plastic oil bottles, in the inverted position whereby the container may be completely emptied without the need for someone to hold the container the entire time. The invention comprises a pair of container lock plates, pivotally secured together, and each having an aperture approximately one and five-sixteenths inches in diameter; larger than the approximate one inch diameter of the neck of standard oil bottles. The lock plates further include a spring loaded clamp which is clipped over the edge of an oil funnel placed within the oil inlet tube of the engine to be serviced. After the invention is clipped into place on the oil funnel, the oil container is next inverted with its mouth and neck placed downward through the lock plate apertures. The lock plates are then pivoted in opposite directions, effectively decreasing the size of the opening and locking the oil container in place in an inverted position for emptying. The container may then be left in place for an extended period for complete emptying while the mechanic is free to accomplish other tasks.

2 Claims, 3 Drawing Sheets

DEVICE FOR HOLDING A CONTAINER INVERTED FOR EMPTYING

TECHNICAL FIELD

This invention relates to support devices, and more particularly to devices which support containers in various orientations during their use.

BACKGROUND ART

Perhaps the best known container support devices are those which support bird and pet feeders and water bottles. These and other container support devices invariably employ a series of vertically spaced, horizontal wire loops, which encircle the feeder or bottle to hold them in an inverted position. Such a configuration is acceptable in these situations since the device is attached to a vertical surface such as a tree or fence, or the side of a cage.

DISCLOSURE OF THE INVENTION

The present invention discloses a device for holding containers, particularly plastic oil bottles, in the inverted position whereby the container may be completely emptied without the need for someone to hold the container the entire time. This is not only economically desirable, but environmentally sound. The invention comprises a pair of container lock plates, pivotally secured together, and each having an aperture approximately one and five-sixteenths inches in diameter; larger than the approximate one inch diameter of the neck of standard oil bottles. The lock plates further include a spring loaded clamp which is clipped over the edge of an oil funnel placed within the oil inlet tube of the engine to be serviced. After the invention is clipped into place on the oil funnel, the oil container is next inverted with its mouth and neck placed downward through the lock plate apertures. The lock plates are then pivoted in opposite directions, effectively decreasing the size of the opening and locking the oil container in place in an inverted position for emptying. The container may then be left in place for an extended period for complete emptying while the mechanic is free to accomplish other tasks.

BRIEF DESCRTIPIOTN OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
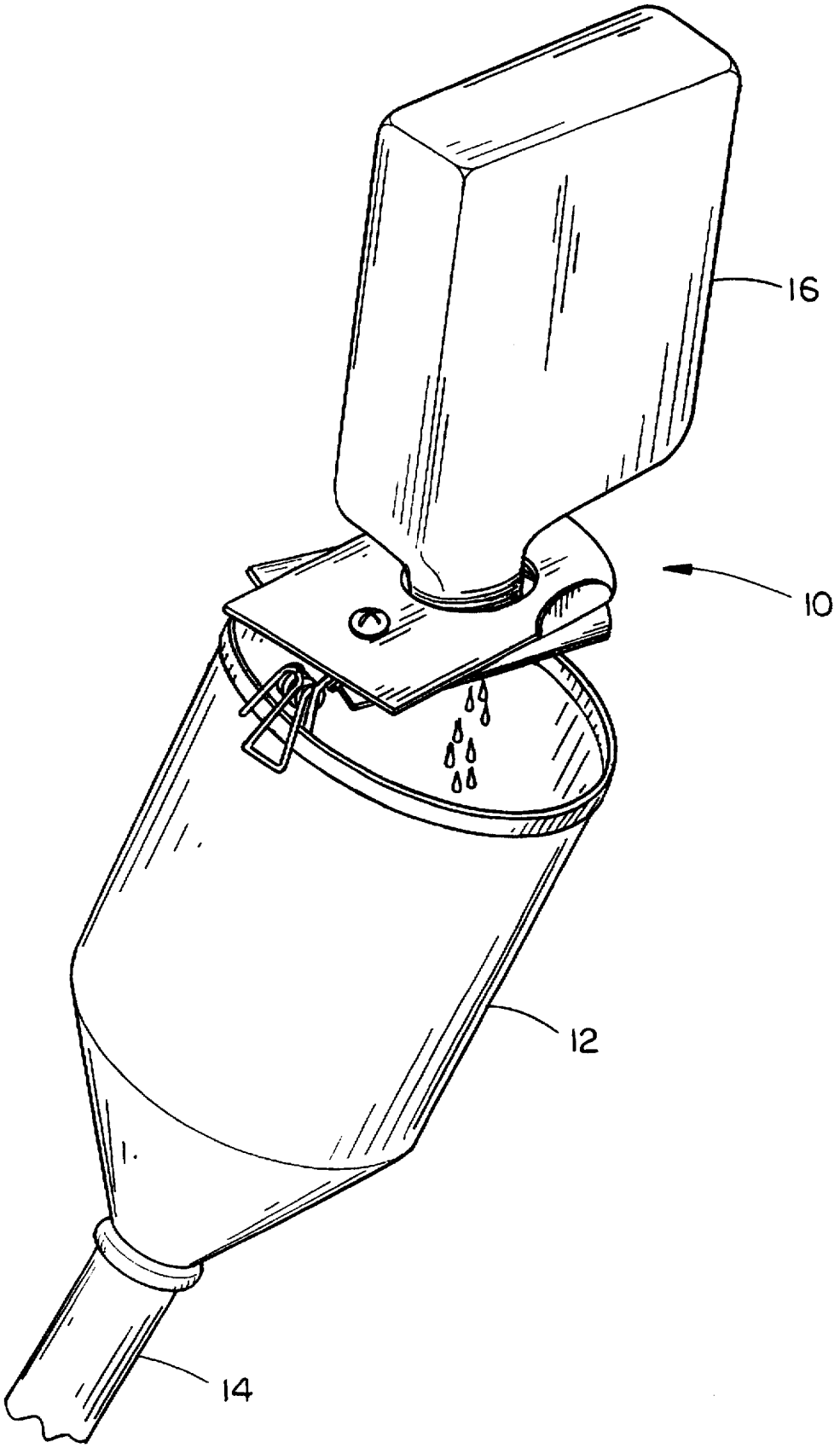
FIG. 1 is a perspective view of the invention in use.
Figure 2:
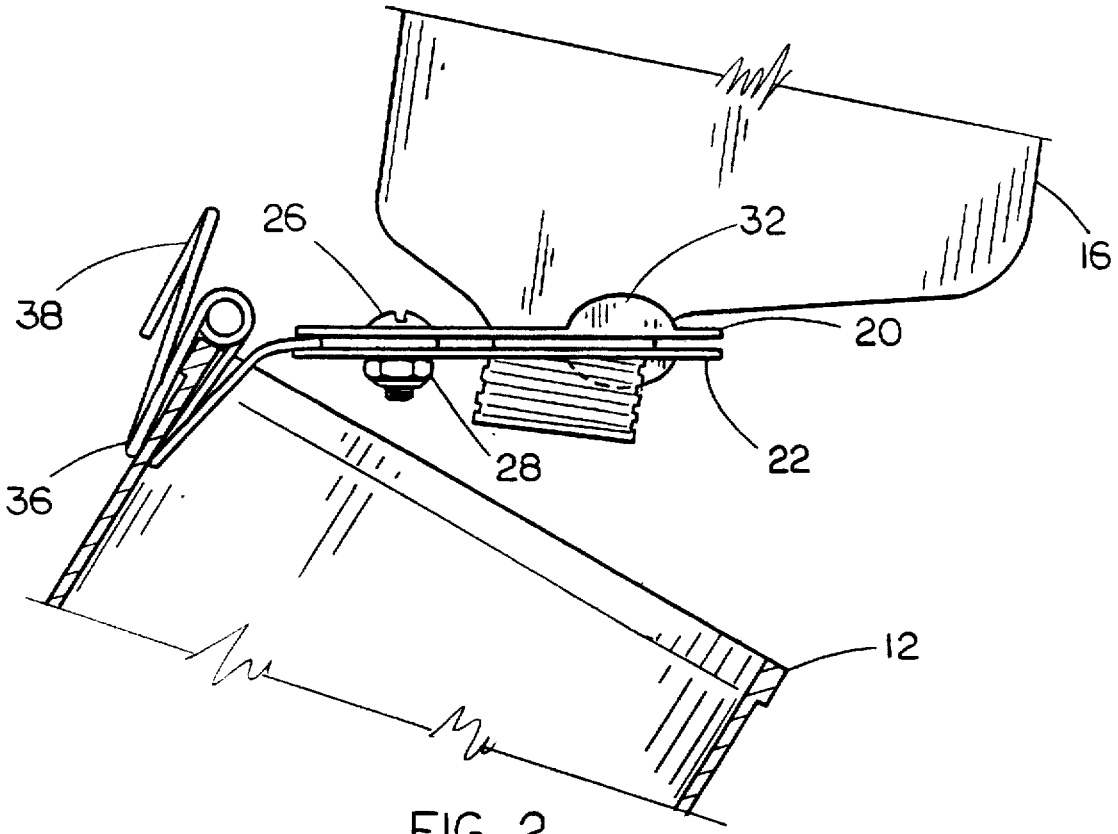
FIG. 2 is a side elevational view of the invention in place on a funnel and supporting an oil container.
Figure 3A:
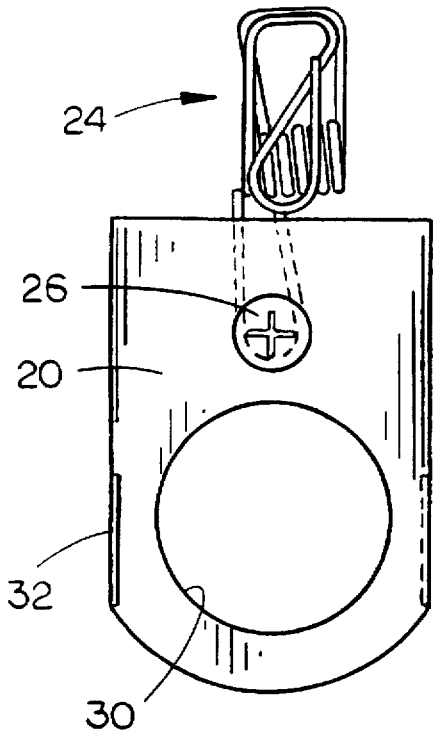
FIG. 3A is a top plan view of the invention with the container lock plate apertures aligned for receipt of a container.
Figure 3B:
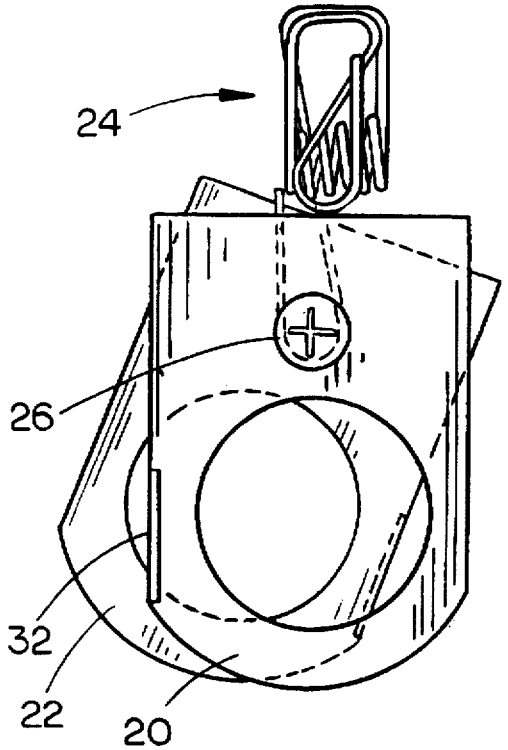
FIG. 3B is a top plan view of the invention with the lock plate apertures misaligned as they would be when holding a container in place.

Referring now to the drawings, wherein like reference numerals designate identical or corresponding parts throughout the several views, FIG. 1 is a perspective view of the invention 10 clipped to a funnel 12 which has been inserted into an oil fill tube 14 of an engine (not shown). The invention 10 is supporting a plastic oil container 16 in the inverted position as it is allowed time to completely drain without the need to waste the mechanics time holding the container 16 for an extended period of time. FIG. 2 is a side elevational view of the invention clipped to the funnel 12, while FIGS. 3A and 3B are top plan views depicting the invention in the container receiving configuration and the container holding configuration, respectively.

Figure 4:
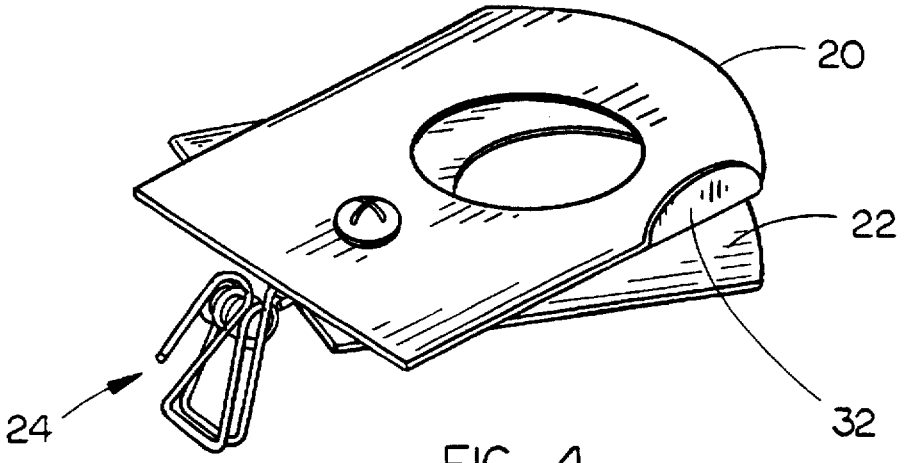
FIG. 4 is a perspective view of the invention.
Figure 5:
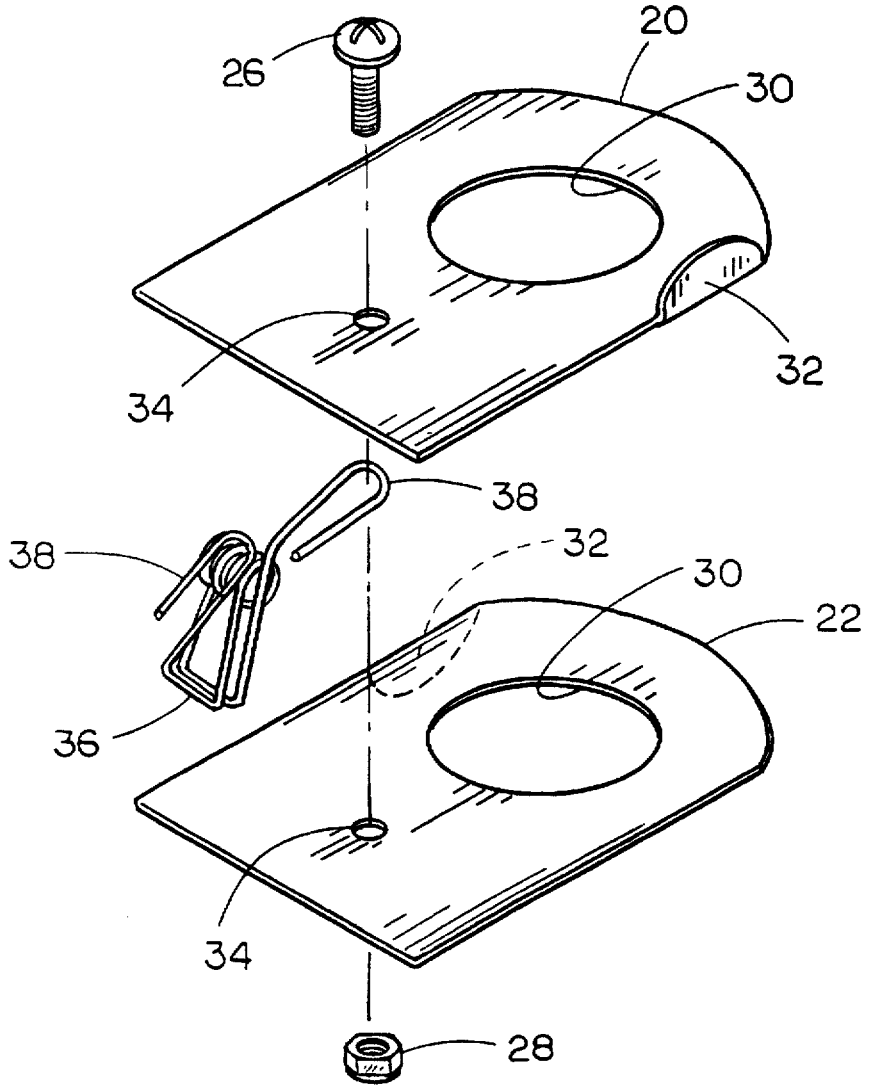
FIG. 5 is an exploded view of the invention.

Referring now to FIG. 4 and FIG. 5, the invention 10 is seen to be comprised of five components: an upper container lock plate 20, a lower container lock plate 22, a clip 24, and a bolt 26 with a nut 28. The upper and lower container lock plates are identical, preferably three inches in length and two inches in width, with a one and five-sixteenths inch hole 30 near one end and a small bolt hole 34 approximately one half inch from the opposing end. Each of the lock plates has a small finger tab 32, extending perpendicularly from the plate on one edge adjacent the hole 30, to aid the fingers in pivoting the plates 20, 22 when locking a container therein. The clip 24, preferably a Coghlan's Clothes Clip available from Coghlan's Ltd. of Winnipeg, Canada, is a spring loaded clip with jaws 36 for engagement with the funnel and a pair of tabs 38 which are squeezed and released to activate the jaws 36. One of the tabs 38 is placed between the two lock plates 20, 22 and around the bolt holes 34. The bolt 26 is then inserted through the bolt holes 34 and secured with a nut 28.

Operation of the invention is as follows. The funnel 12 is first placed within the oil fill tube 14 and the invention is clipped to the edge of the funnel as seen in FIG. 1 and FIG. 2. The opened oil container 16 is then inverted and inserted through the holes 30 of the upper and lower lock plates 20, 22. The lock plates 20, 22 are then rotated slightly in opposite directions by means of the tabs 32 to lock the oil container 16 in place. The mechanic is then free to accomplish other work while the oil container 16 drains completely.

Although only a single embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

What is claimed is:

1. A device for holding a container inverted for emptying, comprising:

(a) a first container lock plate having a first aperture formed therethrough;

(b) a second container lock plate, pivotally affixed to said first container lock plate, and having a second aperture formed therethrough, said first and second lock plates being selectively pivotable to vary the alignment of said first and second apertures from full alignment, through various degrees of partial alignment, the inverted container being received when said apertures are generally fully aligned and being held by pivoting of said lock plates to position said apertures in partial alignment; and (c) a funnel engagement clip secured to said first and second container lock plates.

2. The device as recited in claim 1 wherein said first container lock plate has a first extending finger tab, and said second container lock plate has a second, oppositely extending finger tab.

* * * * *